US008342518B2

(12) United States Patent
Matsumoto

(10) Patent No.: US 8,342,518 B2
(45) Date of Patent: Jan. 1, 2013

(54) SHEET CONVEYING APPARATUS AND IMAGE FORMING APPARATUS

(75) Inventor: So Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/280,577

(22) Filed: Oct. 25, 2011

(65) Prior Publication Data

US 2012/0112406 A1 May 10, 2012

(30) Foreign Application Priority Data

Nov. 9, 2010 (JP) ..... 2010-250906

(51) Int. Cl.
*B65H 9/00* (2006.01)

(52) U.S. Cl. ..... 271/240

(58) Field of Classification Search ..... 271/240, 271/248–252

See application file for complete search history.

(56) References Cited

U.S. PATENT DOCUMENTS 6,273,418 B1 8/2001 Fujikura et al.

FOREIGN PATENT DOCUMENTS

JP 2002-356250 12/2002

*Primary Examiner* — Michael McCullough

(74) *Attorney, Agent, or Firm* — Fitzpatrick, Cella, Harper & Scinto

(57) ABSTRACT

The sheet conveying apparatus includes first to third pairs of skew conveying rollers conveying a sheet, a reference portion, in which the reference portion corrects a skew feeding of the sheet by abutting a side edge of the sheet conveyed by the first to third pairs of skew conveying rollers against a reference surface placed in parallel with the sheet conveying direction, and a guide groove provided on the reference portion, which guides the side edge of the sheet skew-conveyed by the first to third pairs of skew conveying rollers to the reference surface, wherein a vertical width of an opening portion of the guide groove in an upstream area of the reference portion is wider than that of the guide groove in a downstream area of the reference portion, in the sheet conveying direction.

14 Claims, 9 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, in particular, to the sheet conveying apparatus which corrects a skew feeding of a sheet and a position in a width direction of the sheet and the image forming apparatus provided with such a sheet conveying apparatus.

2. Description of the Related Art

Generally, with regard to an image forming apparatus, such as a copying machine, a printer and a facsimile apparatus, when a sheet is conveyed in a skewed state or a positional deviation in a sheet-width direction orthogonal to a sheet conveying direction occurs, an image is formed on the sheet in a deviated state relative to a position in which the image is formed. Therefore, a sheet conveying apparatus used in the image forming apparatus includes a skew-feeding correcting portion for correcting the skew feeding and the positional deviation of the sheet under conveyance.

The skew-feeding correcting portion is arranged on an upstream side of a transfer portion which transfers an image to a sheet. For example, the skew-feeding correcting portion performs the correction according to a side registration reference in which a positional deviation of a sheet under conveyance is corrected with respect to a side edge of the sheet (see U.S. Pat. No. 6,273,418).

The skew-feeding correcting portion which corrects a skew feeding of the sheet by using the side registration reference includes a reference portion for abutting (hereinafter, referred to as a reference portion) arranged on one side of a sheet conveying path and in parallel with the conveying direction of the sheet, and plural pairs of skew conveying rollers arranged on the sheet conveying path. The reference portion has a reference surface in approximately-parallel to the sheet conveying direction. The plural pairs of skew conveying rollers are disposed in approximately-parallel with the reference surface and in the sheet conveying direction.

The pairs of skew conveying rollers skew-convey a sheet under conveyance toward the reference portion to force a side edge of the sheet to abut against the reference surface and convey the sheet along the reference surface, and thereby a skew feeding of the sheet relative to the conveying direction is corrected. In addition, a position of the side edge of the sheet in the direction orthogonal to the sheet conveying direction can be defined according to the reference surface, and hence a positional deviation in the sheet-width direction can be corrected based on the reference surface.

When a skew feeding is corrected based on the side registration reference, if a pressure forcing a sheet to abut against the reference surface (a transportation force by the skew conveying rollers) is excessive while a side edge of the sheet abuts against the reference surface, the sheet buckles and a loop is formed. If the sheet in the shape of the loop is conveyed, the loop bends and thereby a sheet jam may occur.

For solving this problem, a guide groove is formed on the reference portion. The guide groove is formed in the sheet conveying direction and can receive a sheet. A side edge of the sheet is inserted into the guide groove and thereby it is prevented that the loop is formed on the side edge of the sheet.

However, regarding the conventional reference portion as mentioned above, a vertical width of the guide groove (hereinafter, referred to as a guide gap) is a width capable of correcting a thickest sheet which can be inserted into the guide groove. Therefore, the guide gap of the guide groove is too wide for a thin sheet, and hence a generation of a loop is not sufficiently prevented.

For solving this problem, a sheet conveying apparatus provided with a gap adjusting unit was proposed (see Japanese Patent Laid-Open No. 2002-356250). The gap adjusting unit can adjust the guide gap of the guide groove formed on the reference portion to meet a thickness of a sheet.

As illustrated in FIG. 7, the above-mentioned conventional reference portion 31A has a slope portion 15A in order to insert a sheet S into a guide groove 9 after adjusting a guide gap G to meet a thickness of the sheet S. The slope portion 15A is formed on an entire opening of the guide groove 9 and widens toward an outside. A side edge of the sheet S can be easily guided to a reference surface positioned on an inside of the guide groove 9 according to the slope portion 15A formed on the entire opening of the guide groove 9.

As illustrated in FIG. 8, the slope portion 15A includes a pair of slope surfaces 16A, 16A, and hence a predetermined space is formed between the slope surfaces 16A, 16A. Accordingly, for example, if a pressure forcing a sheet to abut against the reference portion 31A is excessive, a loop R is formed within the space of the slope portion 15A.

Since a high-stiffness sheet S of which a basis weight is over 60 (gsm) slips on a pair of skew conveying rollers 32 for skew-conveying the sheet S, a loop of the sheet S is hardly formed. However, since a low-stiffness sheet S (ultra thin paper, and the like) of which a basis weight is under 60 (gsm) may not sufficiently slip on the pair of skew conveying rollers 32, a loop of the sheet S is easily formed. This loop R of the sheet S blocks improvements of corrections to a positional deviation in the direction orthogonal to the sheet conveying direction and a skew of the sheet S relative to the sheet conveying direction.

The present invention provides a sheet conveying apparatus and an image forming apparatus provided with the sheet conveying apparatus, in which the sheet conveying apparatus has a skew-feeding correcting portion capable of appropriately eliminating a loop formed on a sheet regardless of the type of sheet to improve an accuracy of correcting a skew feeding.

SUMMARY OF THE INVENTION

A sheet conveying apparatus according to the present invention includes plural skew conveying portions arranged in the sheet conveying direction, which skew-convey a sheet, a reference portion in which the reference portion corrects a skew feeding of the sheet by abutting a side edge of the sheet conveyed by the skew conveying portions against a reference surface placed in parallel with the sheet conveying direction, and a guide groove provided on the reference portion, which guides the side edge of the sheet conveyed by the skew conveying portions to the reference surface, wherein a vertical width of an opening portion of the guide groove in an upstream area of the reference portion is wider than that of the guide groove in a downstream area of the reference portion, in the sheet conveying direction.

According to the present invention, a loop formed in forcing a sheet to abut against a reference portion is eliminated during a correction executed by forcing the sheet to abut against the reference portion, and hence an accuracy of a skew-feeding correction can be improved.

Further features of the present invention will become apparent from the following description of exemplary embodiments with reference to the attached drawings.

DESCRIPTION OF THE EMBODIMENTS

Hereinafter, an embodiment of an image forming apparatus provided with a sheet conveying apparatus according to the present invention will be described in detail with reference to the accompanying drawings. The image forming apparatus according to the embodiment, such as a copying machine, a printer, a facsimile machine and a composite apparatus thereof, includes the sheet conveying apparatus having a sheet aligning portion which corrects a skew feeding of a sheet under conveyance and a position in a sheet-width direction. In the following embodiment, an intermediate-transfer type image forming apparatus 100 in which a four-color image forming unit is arranged on an intermediate transfer belt is described.

Figure 1:
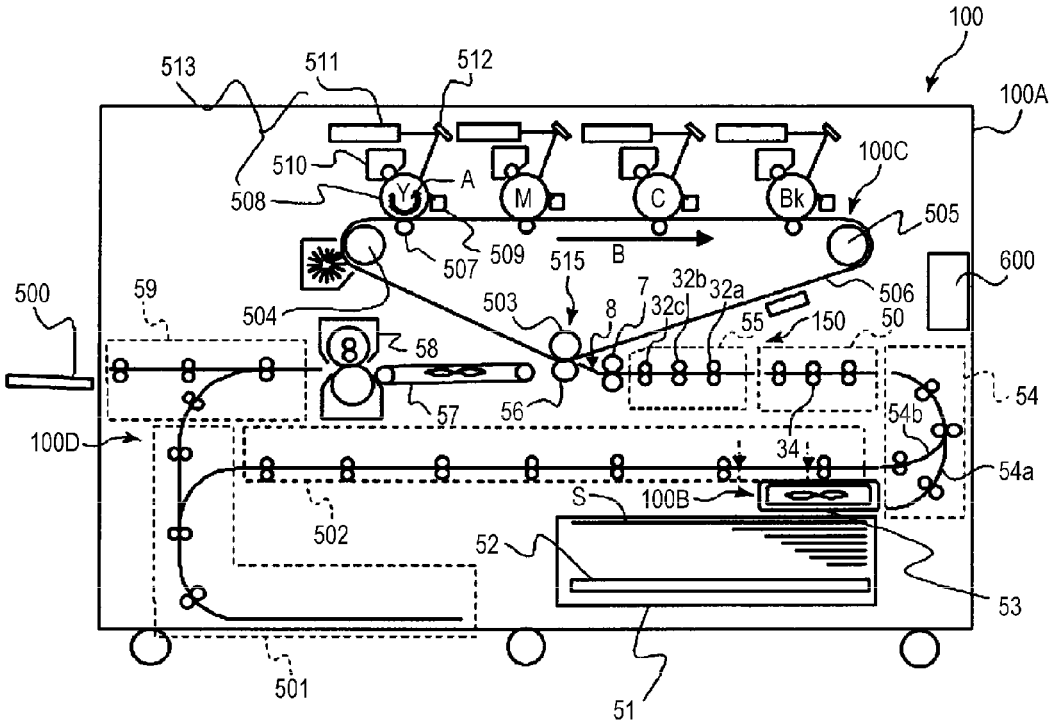
FIG. 1 is a cross-section view schematically illustrating the configuration of an embodiment of an image forming apparatus according to the present invention.

The configuration of the image forming apparatus 100 according to the embodiment is described with reference to FIG. 1. FIG. 1 is a cross-section view schematically illustrating the configuration of the image forming apparatus 100 according to the embodiment.

As illustrated in FIG. 1, the image forming apparatus 100 includes an image forming apparatus body (hereinafter, referred to as an apparatus body) 100A configuring an appearance of the image forming apparatus 100. The apparatus body 100A includes an image forming portion 513, a sheet feeding portion 100B for feeding a sheet S, a transfer portion 100C for transferring a toner image formed by the image forming portion 513 to the sheet S, and a sheet conveying portion 100D as the sheet conveying apparatus for conveying the sheet S.

The image forming portion 513 includes image forming units for yellow (Y), magenta (M), cyan (C) and black (Bk), each of which has a photosensitive drum 508, an exposure portion 511, a development portion 510, a primary transfer portion 507 and a cleaner portion 509, and the like.

The sheet feeding portion 100B includes a sheet containing portion 51 for stocking sheets S in which the sheets S are stacked on a lifting up portion 52, and a sheet feeder portion 53 for feeding the sheet S stocked in the sheet containing portion 51. For example, a system using friction separation by a sheet feeding roller, and the like, or a system using air suction separation may be applied to the sheet feeder portion 53. In this embodiment, the system using air is applied.

The transfer portion 100C includes an intermediate transfer belt 506 driven in a direction indicated by the arrow B as illustrated in FIG. 1. The intermediate transfer belt 506 is tensioned by a drive roller 504, a tension roller 505, a secondary transfer inner-roller 503 and a secondary transfer roller 56, and the like. The intermediate transfer belt 506 receives a predetermined pressure and a predetermined electrostatic load bias from the each primary transfer portion 507, and thereby toner images formed on the photosensitive drums are transferred to the intermediate transfer belt 506. The toner images transferred to the intermediate transfer belt 506 adheres to the sheet S as a pre-fixing image by applying a predetermined pressure and a predetermined electrostatic load bias from a secondary transfer portion 515 including the secondary transfer inner-roller 503 and the secondary transfer roller 56.

The sheet conveying portion 100D includes a conveying unit 54 for conveying the sheet S, a sheet aligning portion 150, a pair of registration rollers 7, a pre-fixing conveying portion 57 for conveying the sheet S to a fixing portion 58, a branched conveying path 59, a reverse-conveying path 501 and a duplex conveying path 502. A sheet conveying path includes the conveying unit 54, the pre-fixing conveying portion 57, the branched conveying path 59, the reverse-conveying path 501 and the duplex conveying path 502, and the like.

The conveying unit 54, the branched conveying path 59, the reverse-conveying path 501 and the duplex conveying path 502 include a plurality of pairs of conveying rollers.

The sheet aligning portion 150 includes a conveying roller portion 50 and a skew-feeding correcting portion 55. The sheet aligning portion 150 corrects a skew feeding of the sheet S and a position of the sheet S in the width direction. The pair of registration rollers 7 includes a drive roller and a driven roller movable to or from the drive roller. The driven roller is pressed to the drive roller to convey a sheet with the drive roller. The pair of registration rollers 7 the sheet S to the secondary transfer portion 515 with a predetermined image formation timing. A controller 600 as illustrated in FIG. 1, is a controlling portion which controls an image forming operation and a skew-feeding correcting operation as mentioned below, including. in the image forming apparatus 100.

Hereinafter, the image forming operation of the image forming apparatus 100 according to the embodiment. Each of sheets S is fed by the sheet feeder portion 53 with a predetermined timing and is conveyed to the sheet aligning portion 150 through a conveying path 54*a* included in the conveying unit 54. Corrections of skew feeding and timing are performed in the sheet aligning portion 150. Subsequently, the sheet S is conveyed to the secondary transfer portion 515 via the pair of registration rollers 7 with a predetermined timing.

At this time, in the image forming portion 513, the photosensitive drums 508 are rotated in a direction indicated by the arrow A as illustrated in FIG. 1, and are uniformly charged by a charging portion (not illustrated). Then, the exposure portions 511 irradiate light to the photosensitive drums 508 under rotation based on a received signal of image information. The light irradiated from the each exposure portion 511 reaches the photosensitive drum 508 via a reflecting portion 512, and the like, and hence an electrostatic latent image is formed on the each photosensitive drum 508. Toner remaining on the photosensitive drums 508 is collected by the cleaner portions 509 to use in a next image forming process.

After the electrostatic latent image is formed on the each photosensitive drum 508, the each development portion 510 performs a toner development on the electrostatic latent image, and thereby a toner image is formed on the each photosensitive drum 508. The each toner image formed on the photosensitive drum 508 is transferred to the intermediate transfer belt 506 by a pressure and an electrostatic load bias according to the primary transfer portion 507. The image formation by each of the yellow, magenta, cyan and black image forming units in the image forming portion 513 is performed with the timing at which the following toner image is overlapped with the upstream toner image which is primary transferred on the intermediate transfer belt 506. Accordingly, a full-color toner image is formed on the intermediate transfer belt 506.

The full-color toner image formed on the intermediate transfer belt 506 is transferred to the sheet S which is conveyed to the secondary transfer portion 515 via the pair of registration rollers 7 with the predetermined timing. The sheet S to which the full-color toner image is transferred is conveyed to the fixing portion 58 by the pre-fixing conveying portion 57. The fixing portion 58 applies a predetermined pressure and a heating effect by a heat source such as a heater to the sheet S, and thereby the toner image is melted and fixed to the sheet S. The sheet S on which the image is fixed is discharged to a discharge tray 500 via the branched conveying path 59. When another image is also formed on the other surface of the sheet S, the sheet S is conveyed to the reverse-conveying path 501 according to a switching member (not illustrated).

Subsequently, the sheet S passes through a re-feeding path 54*b* included in the conveying unit 54 to join a new sheet S of a subsequent job with precise timing, and then the sheet S is conveyed to the secondary transfer portion 515, as mentioned above. The new sheet S is fed from the sheet feeding portion 100B. The image-forming process of the other surface is the same as that of the first surface (one surface), as mentioned above, and hence the description thereof will not be repeated. After forming and fixing the image on the second surface (the other surface) of the sheet S, the sheet S which has the fixed images on the both surfaces thereof is discharged to the discharge tray 500 via the branched conveying path 59.

Figure 2A:
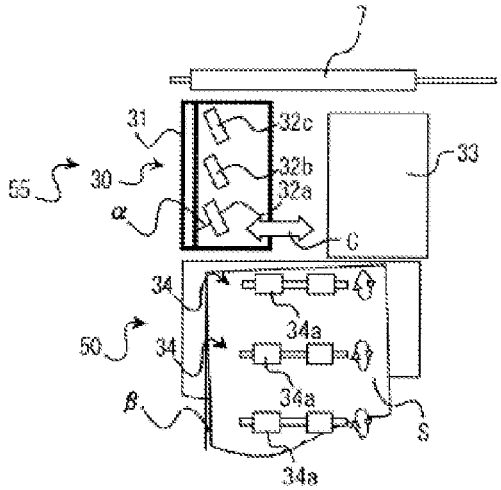
FIG. 2A is a top view illustrating a state of a sheet which is conveyed with a skew feeding on a conveying roller portion.
Figure 2B:
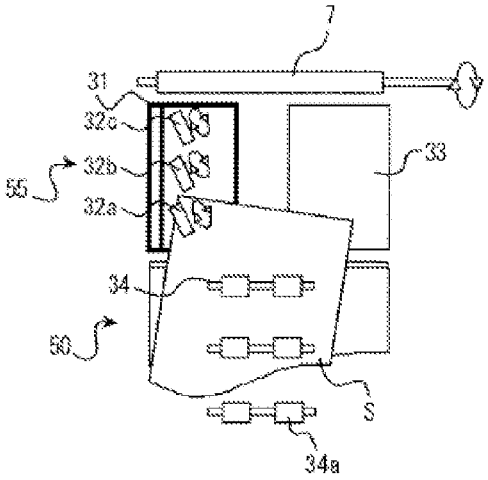
FIG. 2B is a top view illustrating a state of the sheet which is rotated on a skew-feeding correcting portion.
Figure 2C:
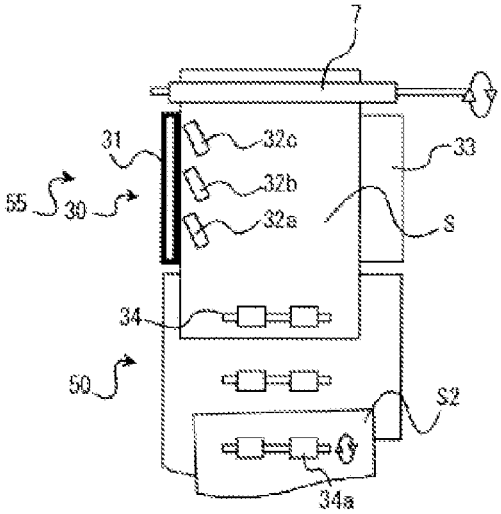
FIG. 2C is a top view illustrating a state of the sheet corrected for a skew feeding which is conveyed on a pair of registration rollers.
Figure 2D:
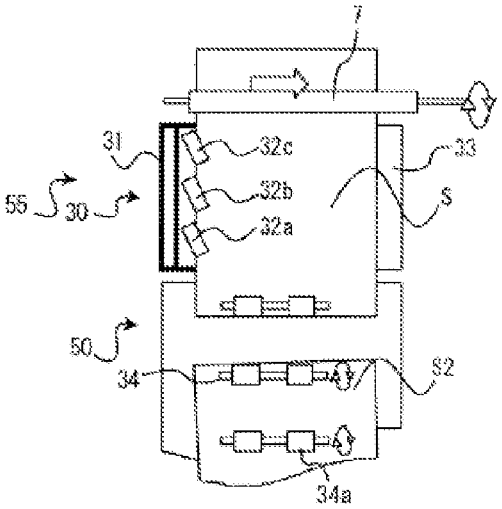
FIG. 2D is a top view illustrating a state of a following sheet which is conveyed with a skew feeding on the conveying roller portion.

The sheet aligning portion 150 which is included in the sheet conveying portion 100D provided in the image forming apparatus 100 according to the embodiment, is described with reference to FIGS. 1 and 2A to 2D. FIG. 2A is a top view illustrating a state of the sheet S which is conveyed with a skew feeding on the conveying roller portion 50. FIG. 2B is a top view illustrating a state of the sheet S which is rotated on the skew-feeding correcting portion 55. FIG. 2C is a top view illustrating a state of the sheet S corrected for a skew feeding which is conveyed on the pair of registration rollers 7. FIG. 2D is a top view illustrating a state of a following sheet S2 which is conveyed with a skew feeding on the conveying roller portion 50.

As illustrated in FIGS. 2A to 2D, the sheet aligning portion 150 is arranged on an upstream side of the secondary transfer portion 515. The sheet aligning portion 150 includes the conveying roller portion 50 and the skew-feeding correcting portion 55 placed on a downstream side of the conveying roller portion 50. In the embodiment, the skew-feeding correcting portion 55 and the pair of registration rollers 7 are integrated with each other as a registration apparatus.

The conveying roller portion 50 includes plural pairs of conveying rollers 34 each of which has drive rollers (not illustrated) and driven rollers 34*a* movable to or from (pressed to or separated from) the drive rollers. The pairs of conveying rollers 34 can be switched between two states according to the driven rollers 34*a* which are pressed to or separated from the drive rollers. In one of the states of the pairs of conveying rollers 34, the drive rollers and the driven rollers 34*a* nip the sheet S therebetween, and in the other of the states of the pairs of conveying rollers 34, the drive rollers and the driven rollers 34*a* release the sheet S from nipping.

The drive rollers are made from a rubber material such as a natural rubber or a synthetic rubber. The driven rollers 34*a* are made from a synthetic resin material. Hereinafter, the state of nipping the sheet S between the drive rollers and the driven rollers 34*a* is also referred to as the "nip state", and the state of releasing the sheet S from nipping is also referred to the "nip release state".

The skew-feeding correcting portion 55 includes a secured guide 33 and an adjustable guide 30. The secured guide 33 acts as a guide for conveying the sheet S regardless of a size of the sheet S. The adjustable guide 30 is capable of moving in the sheet-width direction (indicated by the arrow C as illustrated in FIG. 2A) with respect to a size of the conveyed sheet S. The skew-feeding correcting portion 55 according to the embodiment performs a skew-feeding correction based on a side registration reference, in which a skew feeding and a positional deviation of the sheet are corrected with respect to a side edge of the sheet S under conveyance.

The secured guide 33 is secured onto a sheet conveying path and guides the sheet S to move along the sheet conveying direction. The adjustable guide 30 includes a first pair of skew conveying rollers 32*a*, a second pair of skew conveying rollers 32*b*, a third pair of skew conveying rollers 32*c* and a reference portion 31 which is disposed on a position lateral to the first to third pairs of skew conveying rollers 32*a* to 32*c*.

As illustrated in FIG. 2A, the first to third pairs of skew conveying rollers 32*a* to 32*c* are arranged in sequence from an upstream side and in parallel with the sheet conveying direction. Rotating shafts of the first to third pairs of skew conveying rollers 32*a* to 32*c* slant at an angle of $\alpha$ relative to the sub-scanning direction (sheet conveying direction). Accordingly, the first to third pairs of skew conveying rollers 32*a* to 32*c* are set to force a side edge of the sheet S to abut against the reference portion 31 for positioning the side edge of the sheet S.

Each of the first to third pairs of skew conveying rollers 32*a* to 32*c* includes a drive roller 332 and a driven roller 331 movable to or from (pressed to or separated from) the drive roller 332 (see FIGS. 4A and 4B as mentioned below). The first to third pairs of skew conveying rollers 32*a* to 32*c* can be switched between a nip state for nipping the sheet S and a nip release state for releasing the sheet S from nipping, according to the driven roller 331 which is pressed to or separated from the drive roller 332. The drive roller 332 of each of the first to third pairs of skew conveying rollers 32*a* to 32*c* is made from a rubber material such as a natural rubber or a synthetic rubber. The driven roller 331 is made from a metallic bearing.

The reference portion 31 has a reference surface orthogonal to a conveying surface on which the sheet S is conveyed and in parallel with the sheet conveying direction. As illustrated in FIGS. 2B and 2C, a side edge of the sheet S which is skew-conveyed by the first to third pairs of skew conveying rollers 32*a* to 32*c* is forced to abut against the reference surface, and hence a skew feeding of the sheet S is corrected (aligned).

Figure 3:
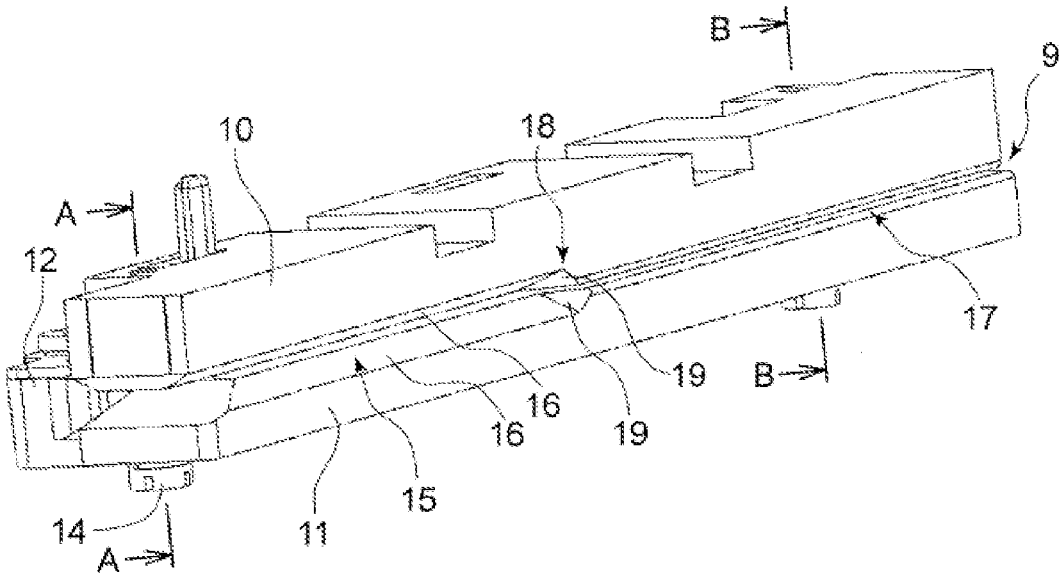
FIG. 3 is a perspective view illustrating a reference portion of the skew-feeding correcting portion according to the embodiment.

The reference portion 31 according to the embodiment is described in detail with reference to FIGS. 3 to 6. FIG. 3 is a perspective view illustrating the reference portion 31 of the skew-feeding correcting portion 55 according to the embodiment. FIG. 4A is a cross-section view of the reference portion 31 as illustrated in FIG. 3 along the line A-A. FIG. 4B is a cross-section view of the reference portion 31 as illustrated in FIG. 3 along the line B-B.

Figure 4A:
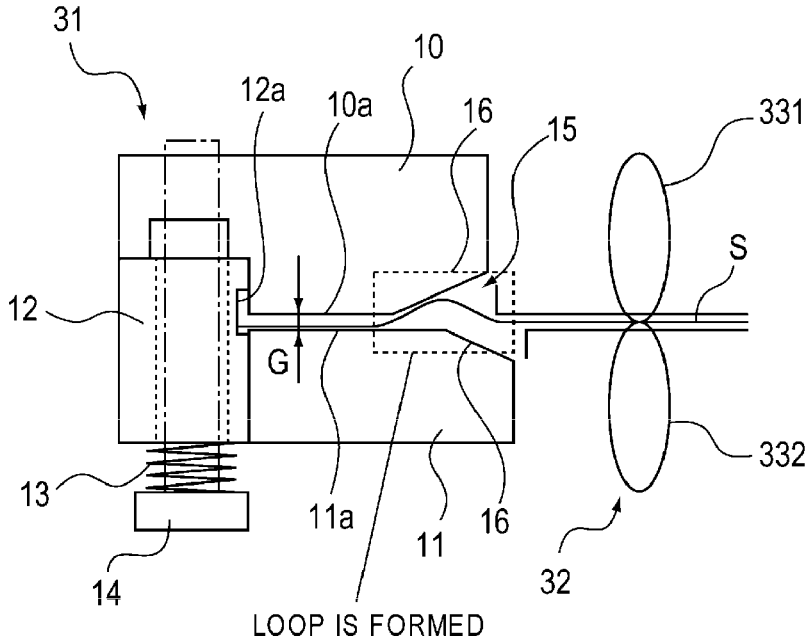
FIG. 4A is a cross-section view of the reference portion as illustrated in FIG. 3 along the line A-A.
Figure 4B:
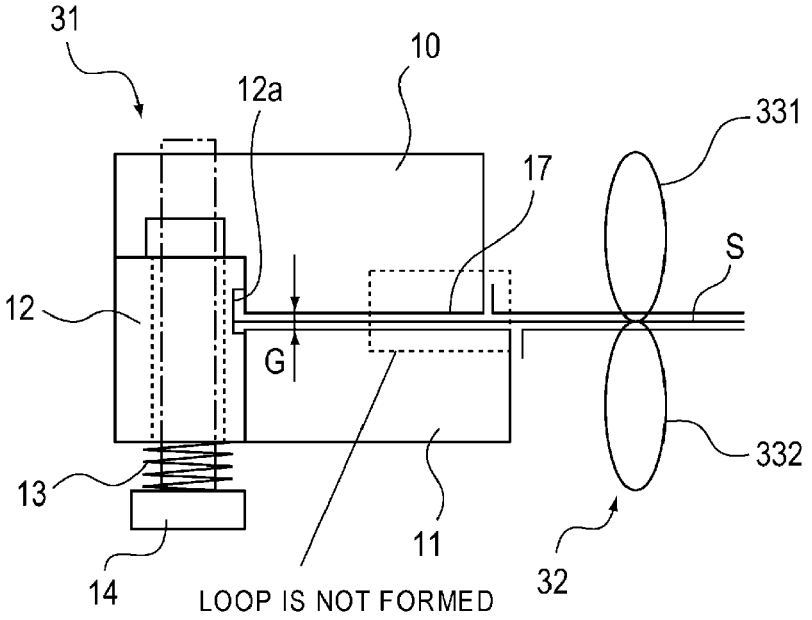
FIG. 4B is a cross-section view of the reference portion as illustrated in FIG. 3 along the line B-B.

As illustrated in FIGS. 3 to 4B, the reference portion 31 includes an upper guide 10, a lower guide 11 placed under the upper guide 10, and a reference block 12 placed on side portions of the upper guide 10 and the lower guide 11.

The upper guide 10 is applied with a force to the lower guide 11 by a compressed spring 13 and is connected with the lower guide 11 by a biasing pin 14 via the reference block 12. The upper guide 10 can be vertically moved relative to the lower guide 11 by adjusting the biasing pin 14, and is configured to be locked at a desired position.

The reference portion 31 has a guide groove 9 formed between the upper guide 10 and the lower guide 11. The guide groove 9 can receive the sheet S along the sheet conveying direction. The guide groove 9 is constructed from the upper guide 10, the lower guide 11 and the reference block 12. A gap (hereinafter, referred to as a guide gap G) between a guide surface 10*a* of the upper guide 10 and a guide surface 11*a* of the lower guide 11 guides a sheet S. A size of the guide gap G is adjustable in response to vertically movement of the upper guide 10. In the reference portion 31, the guide gap G of the guide groove 9 is adjusted according to a thickness of the sheet S to be inserted by vertically moving the upper guide 10.

It is designed that the guide gap G originally has a predetermined width. When a thick sheet S over the predetermined width is conveyed, the guide gap G can broaden in response to the thickness of the sheet S. That is, the pressure pressing the upper guide 10 toward the lower guide 11 is determined so that the guide gap G can broaden without an occurrence of abutting fault, even if a thick sheet is conveyed. In the embodiment, the example that the guide gap G is automatically adjusted in response to a thickness of the sheet S is described. However, the guide gap G may be manually pre-adjusted by a user based on a thickness of the sheet S.

As illustrated in FIGS. 4A and 4B, a reference surface 12*a* is formed on an inside of the guide groove 9 in parallel with the sheet conveying direction. A side edge of the sheet S entering into the guide groove 9 abuts (touches) against the reference surface 12*a*. The reference surface 12*a* is formed on the reference block 12 placed on the side portions of the upper guide 10 and the lower guide 11.

An opening portion of the guide groove 9 has a slope portion 15 formed on an upstream portion thereof in the sheet conveying direction. The slope portion 15 is sloped so that a width of the guide groove 9 gradually widens toward an outside and the width becomes wider than the guide gap G. In particular, the slope portion 15 is made by forming first slope surfaces 16, 16 which widen from the guide surface 10*a* of the upper guide 10 and the guide surface 11*a* of the lower guide 11 to an end of the opening portion. The slope portion 15 guides the sheet S into the guide groove 9. The first slope surfaces 16, 16 of the slope portion 15 certainly guide the sheet S into the guide groove 9, even if a front edge portion of the sheet S is bent.

The opening portion of the guide groove 9 has a parallel portion 17 formed on a downstream portion thereof in the sheet conveying direction. That is, unlike the slope portion 15, in the parallel portion 17, the flat guide surface 11*a* of the upper guide 10 and the flat guide surface 11*a* of the lower guide 11 are extended to the opening portion. The parallel portion 17 is arranged on a downstream side of a position lateral to the second skew conveying roller 32*b* in the sheet conveying direction. That is, the parallel portion 17 is placed on a downstream side of the second skew conveying roller 32*b* in the sheet conveying direction (hereinafter, this area is referred to as a downstream area, and an upstream side of the downstream area is referred to as an upstream area). Preferably, the parallel portion 17 is arranged on a downstream side of a position at which a movement of the sheet S stabilizes, and begins from as upstream as possible.

The slope portion 15 is connected with the parallel portion 17 via a connection portion 18 which slopes from the slope portion 15 to the parallel portion 17 (see FIG. 3). The connection portion 18 includes second slope surfaces 19, 19 which slope from the first slope surfaces 16, 16 of the slope portion 15 to the parallel portion 17 in the sheet conveying direction.

Figure 5A:
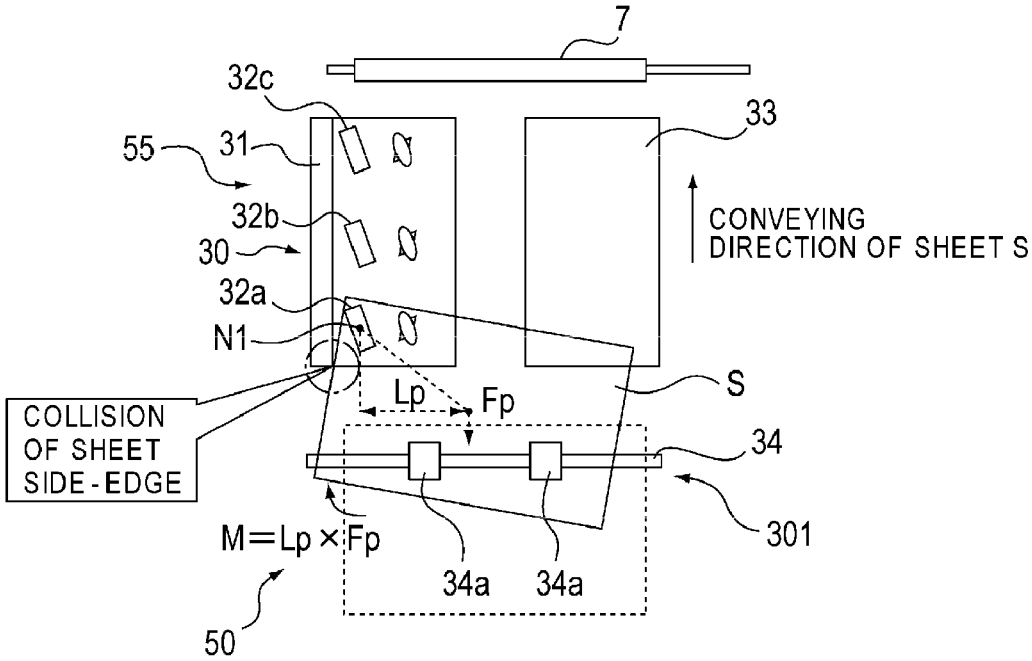
FIG. 5A is a top view illustrating a state of the sheet which is rotated when the sheet is conveyed to the reference portion.
Figure 5B:
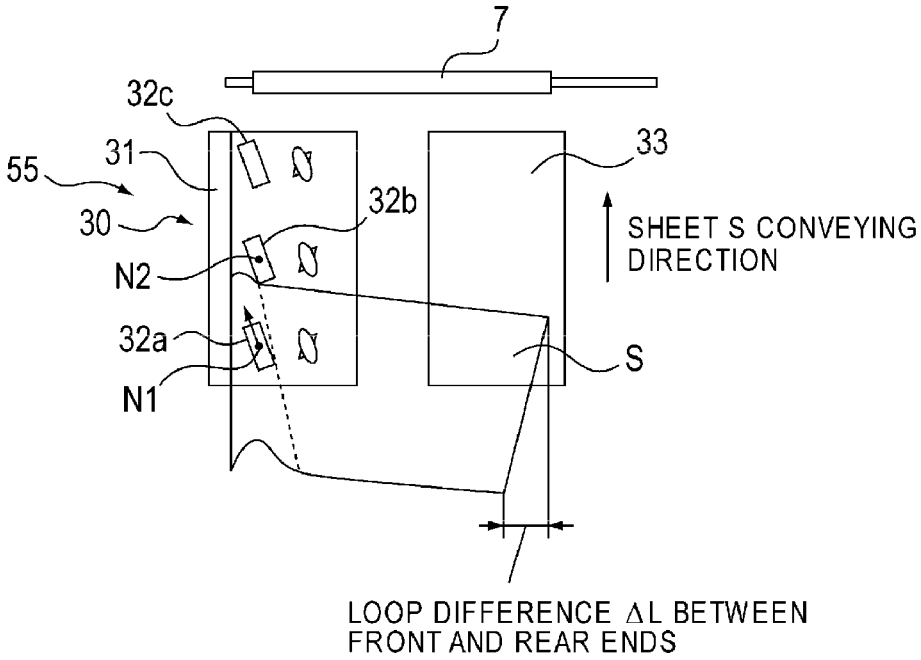
FIG. 5B is a top view illustrating a state of the sheet which abuts against a reference surface of the reference portion.
Figure 5C:
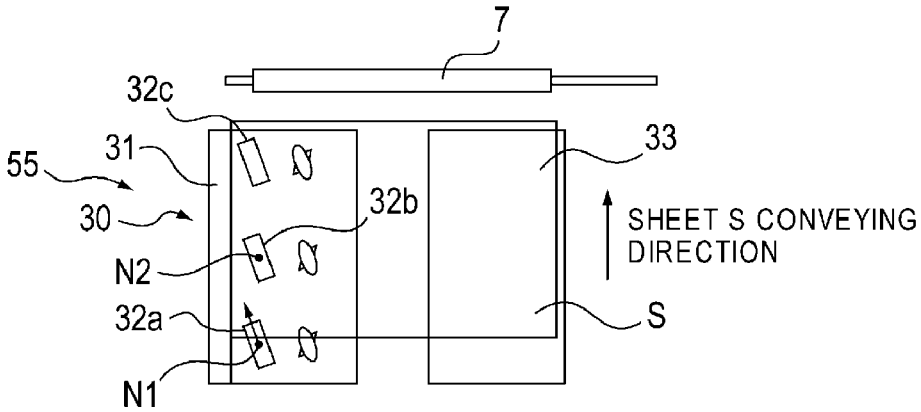
FIG. 5C is a top view illustrating a state of the sheet of which a skew feeding is corrected by the reference portion.
Figure 6:
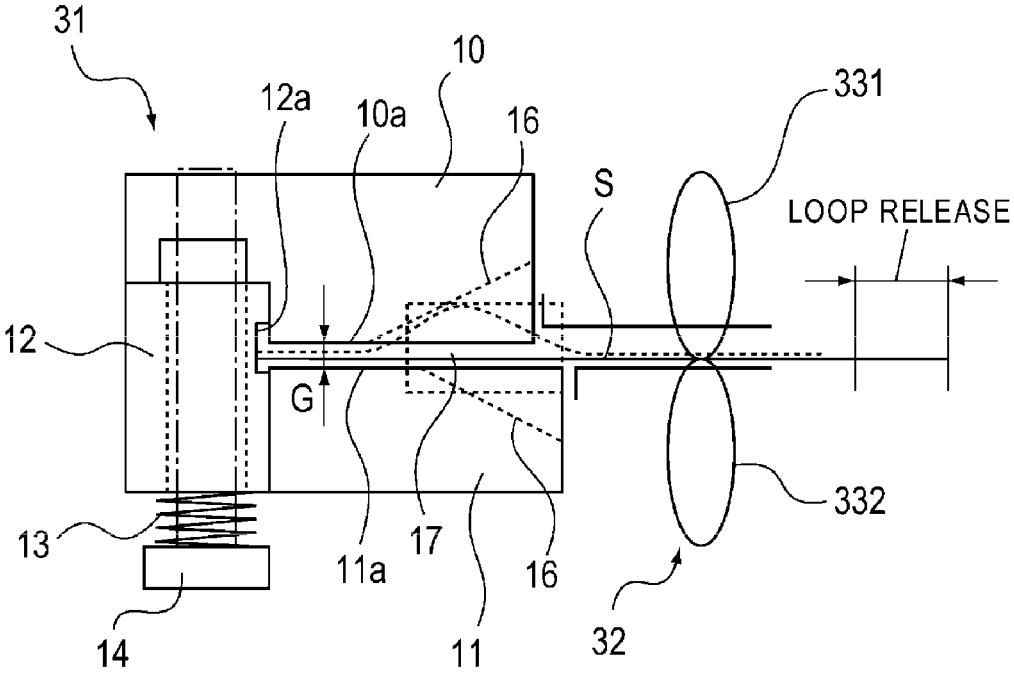
FIG. 6 is a cross-section view illustrating that a loop of the sheet is eliminated by a parallel portion provided in the reference portion according to the embodiment.
Figure 7:
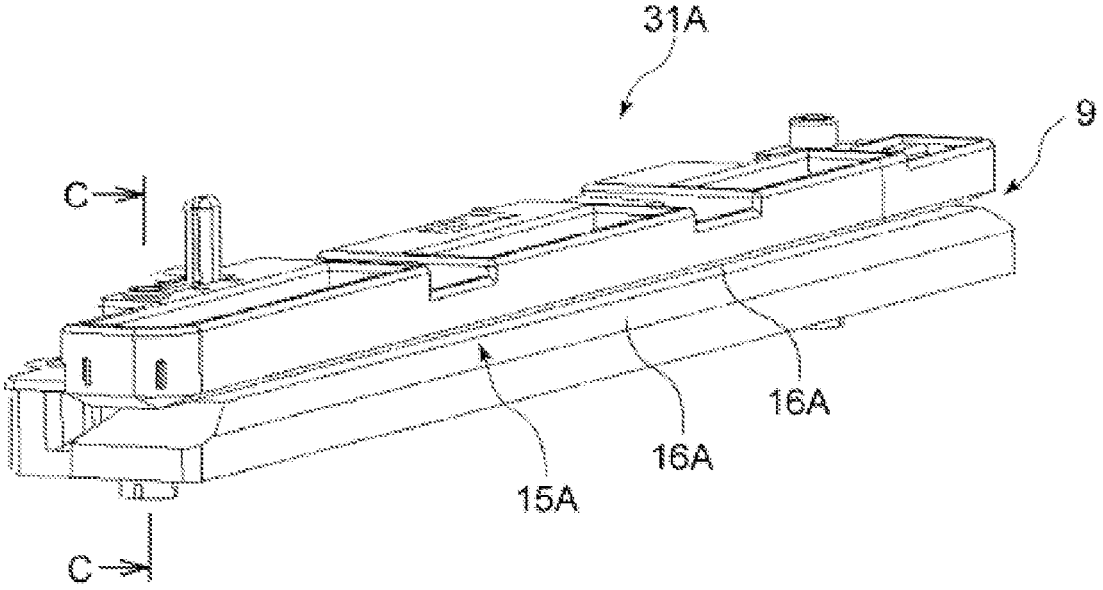
FIG. 7 PRIOR ART
FIG. 7 is a perspective view illustrating a reference portion of a skew-feeding correcting portion according to the related art.
Figure 8:
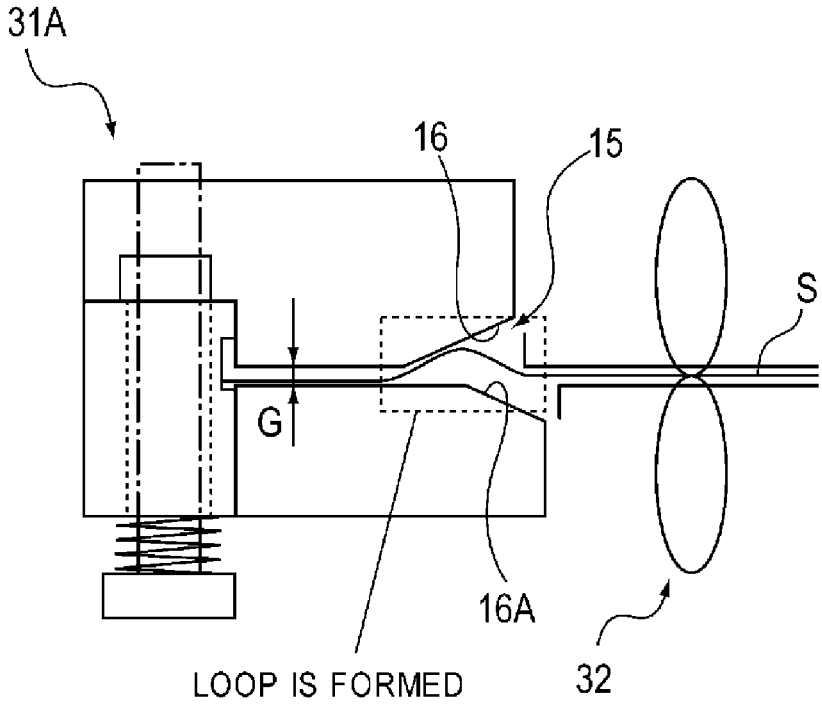
FIG. 8 PRIOR ART
FIG. 8 is a cross-section view of the reference portion as illustrated in FIG. 7 along the line C-C.

Hereinafter, a skew-feeding correcting operation performed by the reference portion 31 according to the embodiment, is described with reference to FIGS. 2A to 2C and 5A to 6. FIG. 5A is a top view illustrating a state of the sheet S which is rotated when the sheet S is conveyed to the reference portion 31. FIG. 5B is a top view illustrating a state of the sheet S which abuts against the reference surface 12*a* of the reference portion 31. FIG. 5C is a top view illustrating a state of the sheet S of which a skew feeding is corrected by the reference portion 31. FIG. 6 is a cross-section view illustrating that a loop of the sheet S is eliminated by the parallel portion 17 provided in the reference portion 31 according to the embodiment.

As illustrated in FIG. 2A, when the sheet S is conveyed from the conveying unit 54 to the conveying roller portion 50 in a skewed state at an angle of β, the sheet S is conveyed to the skew-feeding correcting portion 55 by the pair of conveying rollers 34 in the skewed state. As illustrated in FIG. 2B, the sheet S conveyed to the skew-feeding correcting portion 55 is nipped by the first pair of skew conveying rollers 32*a*. The sheet S nipped by the first pair of skew conveying rollers 32*a* is guided into the guide groove 9 according to the first slope surfaces 16, 16 of the slope portion 15 formed on the upstream area, and is skew-conveyed toward the reference portion 31.

The nip operation of the pair of conveying rollers 34 is released, when the sheet S begins to be conveyed by the first pair of skew conveying rollers 32*a*. Therefore, the sheet S is nipped by only the first pair of skew conveying rollers 32*a*, and hence a posture of the sheet S is variable. In particular, at the moment of nipping of the first pair of skew conveying rollers 32*a*, since the sheet S does not abut against the reference surface 12*a* of the reference portion 31, a movement of the sheet S is unstable. Thereafter, the sheet S is skew-conveyed by the first pair of skew conveying rollers 32*a* to abut against the reference surface 12*a*. When the sheet S abuts against the reference surface 12*a*, the first pair of skew conveying rollers 32*a* (skew-) conveys the sheet S with a correction of the posture of the sheet S due to the unstable state as mentioned above.

The first pair of skew conveying rollers 32*a* and the second pair of skew conveying rollers 32*b* are arranged, so that the first pair of skew conveying rollers 32*a* forces the sheet S to abut against the reference surface 12*a* of the reference portion 31 and then a movement of the sheet S is stabilized before the sheet S is nipped by the second pair of skew conveying rollers 32*b*. Therefore, when the sheet S is nipped by the second pair of skew conveying rollers 32*b*, since the sheet S is nipped by the first pair of skew conveying rollers 32*a* and the second pair of skew conveying rollers 32*b*, the unstable state is eliminated and the movement of the sheet S is stabilized. As illustrated in FIG. 2C, when the sheet S is nipped by the second pair of skew conveying rollers 32*b*, the sheet S stably abuts (is forced to abut) against the reference surface 12*a* of the reference portion 31 and the skew feeding of the sheet S is corrected.

As mentioned above, a movement of the sheet S is unstable at the position where the sheet S is nipped by only the first pair of skew conveying rollers 32*a*. Therefore, in the embodiment, in order to certainly guide a side edge of the sheet S to the reference surface 12*a* of the reference portion 31 within the upstream area in the sheet conveying direction, the slope portion 15 including the first slope surfaces 16, 16 which are formed in the vertical direction, is provided. However, as the result of provision of the slope portion 15, a space of the slope portion 15 (between the two first slope surfaces 16, 16) becomes a region generating a loop of the sheet S, if a pressure forcing the sheet S to abut against the reference surface 12*a* is excessive.

For example, a loop R is generated owing to a rotation of the sheet S in response to a moment M which acts on the sheet S when the sheet S enters into the skew-feeding correcting portion 55. In particular, as illustrated in FIG. 5A, when the sheet S is nipped by the first pair of skew conveying rollers 32*a*, a force Fp in the direction opposite to the sheet conveying direction occurs on a centroid of the sheet S. If a distance from the centroid to a side edge of the sheet is Lp, the moment M (=Fp×Lp) which causes the sheet S to rotate in the direction indicated by the arrow D as illustrated in FIG. 5A occurs on the side edge of the sheet S. The sheet S rotates according to the moment M.

The rotation of the sheet S causes a side edge of a rear portion of the sheet S to collide against the reference portion 31. After the side edge of the sheet S collides, when the first pair of skew conveying rollers 32*a* further forces the sheet S to abut against the reference surface 12*a* of the reference portion 31, in the slope portion 15 of the reference portion 31, a loop which increases toward a rear side of the sheet S is generated on the sheet S. A loop difference Δ between a front end and a rear end of the sheet triggers a skew feeding in which the sheet S slants in the sheet abutting direction (see FIG. 5B).

In the embodiment, in the downstream area (the downstream side of the second pair of skew conveying rollers 32*b*) in which an unstable movement of the sheet S does not occur and a stable abutting is implemented, the parallel portion 17 is provided in the reference portion 31 in order to prevent a generation of a loop R of the sheet S. A loop R of the sheet S is not generated in the parallel portion 17. Furthermore, the parallel portion 17 controls the loop R of the sheet S generated in the slope portion 15 and eliminates the loop R of the sheet S by slipping the first pair of skew conveying rollers 32*a* and the second pair of skew conveying rollers 32*b*. Also, in the parallel portion 17, the above-mentioned skew feeding of the sheet S due to a generation of the loop R is prevented.

When a skew feeding of the sheet S occurs due to the above-mentioned loop elimination, since the second pair of skew conveying rollers 32*b* and the third pair of skew conveying rollers 32*c* are arranged in a position lateral to the parallel portion 17, the skew feeding is corrected by the second pair of skew conveying rollers 32*b* and the third pair of skew conveying rollers 32*c*.

In the embodiment, the connection portion 18 including the second slope surfaces 19, 19 is provided between the slope portion 15 and the parallel portion 17, and hence the sheet S is smoothly transferred from the slope portion 15 to the parallel portion 17.

The image forming apparatus 100 according to the present embodiment as mentioned above, has the following advantageous effects. The image forming apparatus 100 according to the present embodiment has the slope portion 15 formed on the upstream portion of the opening portion of the reference portion 31 and the parallel portion 17 formed on the downstream portion of the opening portion. Therefore, even if a loop R is formed on the sheet S in the slope portion 15, the loop R can be easily eliminated by the parallel portion 17. Accordingly, a skew feeding of the sheet S can be corrected regardless of the type of sheet and an accuracy of correcting a skew feeding can be improved.

The connection portion 18 is provided between the slope portion 15 and the parallel portion 17, and thereby the sheet S can be smoothly transferred from the slope portion 15 to the parallel portion 17. Accordingly, the loop R can be smoothly eliminated.

For example, in the case of an ultra thin sheet of which a basis weight is 40 (gsm), the skew feeding after correction was 3 (mm) in the conventional apparatus. In contrast, the skew feeding after correction could be reduced to 0.5 (mm) by using the reference portion 31 according to the present embodiment. That is, a sheet conveying apparatus having a skew-feeding correcting portion capable of correcting a skew feeding with high accuracy can be provided by using the reference portion 31 according to the present embodiment. Furthermore, an image forming apparatus with high image position accuracy can be provided by applying this sheet conveying apparatus to the image forming apparatus.

While the embodiment of the present invention has been described, it is to be understood that the present invention is not limited to the disclosed exemplary embodiment. Furthermore, the advantageous effects as described in the embodiment of the present invention correspond to preferred advantageous effects according to the present invention, it is to be understood that advantageous effects according to the present invention are not limited to the disclosures in the embodiment of the present invention.

For example, in the present embodiment, the skew-feeding correcting portion 55 is placed on the upstream side of the secondary transfer portion 515. However, the present invention is not limited to the embodiment. For example, other than the upstream side of the secondary transfer portion 515, the skew-feeding correcting portion may be applied to an upstream side of a sheet-post-processing apparatus in an a sheet discharge system after fixing, or the like.

In the present embodiment, the slope portion 15 is connected with the parallel portion 17 via the second slope surfaces 19 of the connection portion 18. However, the present invention is not limited to the embodiment. For example, the slope portion 15 may be directly connected with the parallel portion 17 by bending the first slope surfaces 16 included in the slope portion 15.

In the present embodiment, the slope portion 15 arranged on the upstream area and the parallel portion 17 arranged on the downstream area have been described. However, a slope portion may be formed instead of the parallel portion 17. In this example, although slope surfaces are also formed in the downstream area so that the slope surfaces widen from the guide surfaces to the end of the opening portion, as the slope portion 15, the slope surfaces of the upstream area may be longer than the slope surfaces of the downstream area. In addition, the slope surfaces of the downstream area may be set to a size capable of eliminating the loop R (for example, about one millimeter slope surfaces or curved surfaces). According to the slope surfaces formed on the downstream area, a sheet may be prevented from blemishes compared with a sharp edged opening, and hence damages to a sheet can be reduced. In this case, the slope surfaces of the upstream area may be connected with the slope surfaces of the downstream area via slope surfaces, as the above-mentioned embodiment.

In the present embodiment, the first slope surfaces 16, 16 and the second slope surfaces 19, 19 are formed on the upper guide 10 and the lower guide 11, respectively. However, the present invention is not limited to the embodiment. For example, the first slope surface 16 and the second slope surface 19 may be formed on one of the upper guide 10 and the lower guide 11. In addition, if the opening portion of the upstream portion is wider than the internal width of the guide groove to be able to easily insert the sheet S into the guide groove 9, the first slope surfaces 16, 16 may not be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-250906, filed Nov. 9, 2010, which is hereby incorporated by reference herein in its entirety.

What is claimed is:

1. A sheet conveying apparatus comprising:

plural skew conveying portions arranged in a sheet conveying direction, which skew-convey a sheet;

a reference portion in which the reference portion corrects a skew feeding of the sheet by abutting a side edge of the sheet conveyed by the skew conveying portions against a reference surface placed in parallel with the sheet conveying direction; and a guide groove provided on the reference portion, which guides the side edge of the sheet conveyed by the skew conveying portions to the reference surface, wherein a vertical width of an opening portion of the guide groove in an upstream area of the reference portion is wider than that of the guide groove in a downstream area of the reference portion, in the sheet conveying direction.

2. The sheet conveying apparatus according to claim 1, wherein the vertical width of the opening portion of an upstream portion of the guide groove in the sheet conveying direction is wider than a vertical width of an internal portion of the guide groove, and wherein the vertical width of the opening portion of an downstream portion of the guide groove in the sheet conveying direction is equal to the vertical width of the internal portion of the guide groove.

3. The sheet conveying apparatus according to claim 1, wherein at least one slope surface by which the opening portion is widened from a guide surface of the guide groove toward an end of the opening portion is formed, and wherein the slope surface in the upstream area of the reference portion is longer than the slope surface in the downstream area of the reference portion.

4. The sheet conveying apparatus according to claim 3, wherein the slope surface in the upstream area of the guide groove is connected with the slope surface in the downstream area of the guide groove via at least one slope surface.

5. The sheet conveying apparatus according to claim 1, wherein the upstream area of the reference portion includes at least one slope surface by which the opening portion is widened from a guide surface of the guide groove toward an end of the opening portion, and wherein the downstream area of the reference portion includes a flat surface corresponding to the guide surface of the guide groove, in which the flat surface is extended to the end of the opening portion.

6. The sheet conveying apparatus according to claim 5, wherein the at least one slope surface in the upstream area of the guide grove is connected with the flat surface in the downstream area of the guide groove via a slope surface.

7. The sheet conveying apparatus according to claim 1, wherein the plural skew conveying portions include a first pair of skew conveying rollers and a second pair of skew conveying rollers arranged on a downstream side of the first pair of skew conveying rollers, and wherein the downstream area of the guide groove is placed on a position lateral to the second pair of skew conveying rollers or a position corresponding to a downstream side of the position lateral to the second pair of skew conveying rollers, in the sheet conveying direction.

8. An image forming apparatus having a sheet feeding apparatus; an image forming portion which forms an image on a sheet fed from the sheet feeding apparatus, the sheet feeding apparatus comprising;

plural skew conveying portions arranged in a sheet conveying direction, which skew-convey a sheet;

a reference portion in which the reference portion corrects a skew feeding of the sheet by abutting a side edge of the sheet conveyed by the skew conveying portions against a reference surface placed in parallel with the sheet conveying direction; and a guide groove provided on the reference portion, which guides the side edge of the sheet conveyed by the skew conveying portions to the reference surface, wherein a vertical width of an opening portion of the guide groove in an upstream area of the reference portion is wider than that of the guide groove in a downstream area of the reference portion, in the sheet conveying direction.

9. The image forming apparatus according to claim 8, wherein the vertical width of the opening portion of an upstream portion of the guide groove in the sheet conveying direction is wider than a vertical width of an internal portion of the guide groove, and wherein the vertical width of the opening portion of an downstream portion of the guide groove in the sheet conveying direction is equal to the vertical width of the internal portion of the guide groove.

10. The image forming apparatus according to claim 8, wherein at least one slope surface by which the opening portion is widened from a guide surface of the guide groove toward an end of the opening portion is formed, and wherein the slope surface in the upstream area of the reference portion is longer than the slope surface in the downstream area of the reference portion.

11. The image forming apparatus according to claim 10, wherein the slope surface in the upstream area of the guide groove is connected with the slope surface in the downstream area of the guide groove via at least one slope surface.

12. The image forming apparatus according to claim 8, wherein the upstream area of the reference portion includes at least one slope surface by which the opening portion is widened from a guide surface of the guide groove toward an end of the opening portion, and wherein the downstream area of the reference portion includes a flat surface corresponding to the guide surface of the guide groove, in which the flat surface is extended to the end of the opening portion.

13. The image forming apparatus according to claim 12, wherein the at least one slope surface in the upstream area of the guide grove is connected with the flat surface in the downstream area of the guide groove via a slope surface.

14. The image forming apparatus according to claim 8, wherein the plural skew conveying portions include a first pair of skew conveying rollers and a second pair of skew conveying rollers arranged on a downstream side of the first pair of skew conveying rollers, and wherein the downstream area of the guide groove is placed on a position lateral to the second pair of skew conveying rollers or a position corresponding to a downstream side of the position lateral to the second pair of skew conveying rollers, in the sheet conveying direction.

* * * * *